US005868955A

United States Patent [19]

Tavernier

[11] Patent Number: 5,868,955

[45] Date of Patent: Feb. 9, 1999

[54] FEED RESERVOIR INTENDED FOR RETAINING A MOLTEN METAL, AND IN PARTICULAR A STEEL

[75] Inventor: Hervé Tavernier, Metz, France

[73] Assignee: Ugine Savoie-Usinor, Puteaux, France

[21] Appl. No.: 982,037

[22] Filed: Dec. 1, 1997

[30] Foreign Application Priority Data

Dec. 11, 1996 [FR] France ..... 96 15193

[51] Int. Cl.[6] ..... B22D 37/00

[52] U.S. Cl. ..... 222/590; 222/594; 266/229; 266/275

[58] Field of Search ..... 266/229, 275; 222/590, 594; 164/337

[56] References Cited

U.S. PATENT DOCUMENTS

| | | | |
|---|---|---|---|
| 4,739,972 | 4/1988 | Podrini | 244/229 |
| 4,776,570 | 10/1988 | Vo Thanh et al. | 266/229 |
| 5,169,591 | 12/1992 | Schmidt et al. | 266/275 |
| 5,247,987 | 9/1993 | Tavernier et al. | 164/428 |
| 5,518,153 | 5/1996 | Zacharias et al. | 222/594 |

FOREIGN PATENT DOCUMENTS

| | | |
|---|---|---|
| 26 57 406 A | 6/1978 | Germany . |
| 34 25 081 A | 1/1986 | Germany . |
| 96 14951 A | 5/1996 | WIPO . |

*Primary Examiner*—Scott Kastler

*Attorney, Agent, or Firm*—Oblon, Spivak, McClelland, Maier & Neustadt, P.C.

[57] ABSTRACT

Feed reservoir intended for retaining a molten metal and in particular a steel, which reservoir comprises a refractory bottom, refractory walls, at least one nozzle placed in the refractory bottom in order to feed at least one mold with molten metal, a refractory buffer having a buffer bottom and an approximately vertical partition defining a cavity, the buffer being arranged on the bottom of the reservoir in order, on the one hand, to receive a jet of molten metal coming from a ladle which is moved above said reservoir and, on the other hand, to ensure that said reservoir is separated into two spaces, a first space having at least one nozzle and a second space, the cavity of the buffer, confining the molten metal, which metal then flows out into the first space by spilling over the top of the partition, wherein the buffer, the partition of which defines the second space, is divided into two zones by a barrier, a zone receiving the jet of metal and a zone in which the metal rises, the latter zone being located on the opposite side from the first space with respect to the jet.

9 Claims, 5 Drawing Sheets

FEED RESERVOIR INTENDED FOR RETAINING A MOLTEN METAL, AND IN PARTICULAR A STEEL

BACKGROUND OF THE INVENTION

1. Field of the Invention

The invention relates to a feed reservoir intended for retaining a molten metal and in particular a steel, the reservoir comprising a refractory bottom, refractory walls, at least one nozzle placed in the refractory bottom in order to feed at least one casting line with molten metal, a refractory buffer having a buffer bottom and an approximately vertical partition defining a cavity, the buffer being placed on the bottom of the reservoir in order, on the one hand to receive a jet of molten metal coming from a ladle which is moved above said reservoir and, on the other hand, to ensure that the contents of the reservoir are separated into two spaces, a first space having at least one nozzle and a second space, the cavity of the buffer, confining the molten metal, which metal then flows out into the first space by spilling over the top of the partition.

2. Related Art

The downstream production of a steel takes place in a sequence involving a pouring ladle which empties into a feed reservoir called a distributor or tundish, the feed reservoir delivering liquid metal to at least one casting mold.

The feed reservoir constitutes the transfer reactor between the pouring ladle and the casting mold.

The functions of the feed reservoir or tundish are:

- to transfer the liquid metal from the pouring ladle to the casting mold,
- to distribute the liquid metal to the various casting lines and molds,
- to supply the molten metal to the mold or molds in a nonturbulent state,
- to carry out the casting operations in sequence,
- to eliminate, under certain conditions, the coarsest inclusions contained in the liquid metal by using, for example, linings or bubbling rails.

The operation of the feed reservoir is improved by the use of a lining such as, for example, an impact slab or buffer placed on the bottom of the reservoir, vertically below a jet shroud tube located under the pouring ladle.

In general, the function of the buffer is firstly to reduce the turbulence of the jet of liquid metal coming from the pouring ladle and entering the reservoir by reducing the energy of the jet of liquid metal falling vertically into the reservoir.

In some cases, the buffer may limit short circuits, i.e. the periods after which the first fluid stream of metal leaves the reservoir and/or may increase the residence times, i.e. the periods during which fluid streams of metal are present in the reservoir.

BRIEF SUMMARY OF THE INVENTION

The object of the invention is to provide a specific zone for reducing the energy of the incoming jet of liquid metal, in particular steel, and at the same time to decrease the turbulence of the jet of metal by reducing its energy.

The subject of the invention is a feed reservoir intended for retaining a molten metal and in particular a steel, wherein the buffer, the partition of which defines the second space, is divided into two zones by a barrier, a zone receiving the jet of metal and a zone in which the metal rises, the latter zone being located on the opposite side from the first space with respect to the jet.

The other characteristics of the invention are:

- the buffer has at least one partition part extending above the spillover level,
- the barrier ensures that the flow of metal passes from the zone receiving the jet of metal to the zone in which the metal rises, by means of at least one rise hole provided in said barrier,
- the rise hole provided in the barrier is located close to the buffer bottom,
- the buffer has at least one drain hole,
- the buffer is placed in contact with at least one wall of the reservoir so that the zone in which the metal rises is located on the opposite side from the first space having at least one nozzle, with respect to the jet of metal leaving the ladle,
- the buffer is composed of a separating partition, a bottom, and a barrier defining a C-shaped section,
- the buffer is composed of a separating partition, a bottom and a barrier, in two separate pieces, the separating partition forming an L-shaped section with the buffer bottom,
- the buffer is composed of a separating partition and a barrier, in two separate pieces, the separating partition having the shape of a plate.

The invention also relates to a process for transferring a molten metal, and in particular a steel, from a pouring ladle to at least one casting line, in which process the molten metal is poured into a feed reservoir intended for retaining the metal, the reservoir comprising a refractory bottom, refractory walls, at least one nozzle placed in the refractory bottom in order to feed at least one casting line with molten metal, a refractory buffer having a buffer bottom and an approximately vertical partition defining a cavity, the buffer being placed on the bottom of the reservoir in order, on the one hand, to receive a jet of molten metal coming from a ladle which is moved above said reservoir and, on the other hand, to ensure that said reservoir is separated into two spaces, a first space having at least one nozzle and a second space, the cavity of the buffer, confining the metal, which metal then flows out into the first space by spilling over the top of the partition, wherein:

- the jet coming from the ladle is moved, in the buffer, so as to orient it in a direction away from the first space having at least one nozzle,
- the jet is directed so that it rises approximately vertically,
- the metal is moved so that the wave generated by the rise is directed transversely, after spillover, toward the jet from the ladle in the direction of the first space.

The description which follows and the appended figures, all given by way of non-limiting example, will make the invention clearly understood.

DESCRIPTION OF THE SEVERAL VIEW OF THE DRAWINGS

DETAILED DESCRIPTION OF THE INVENTION

Figure 1:
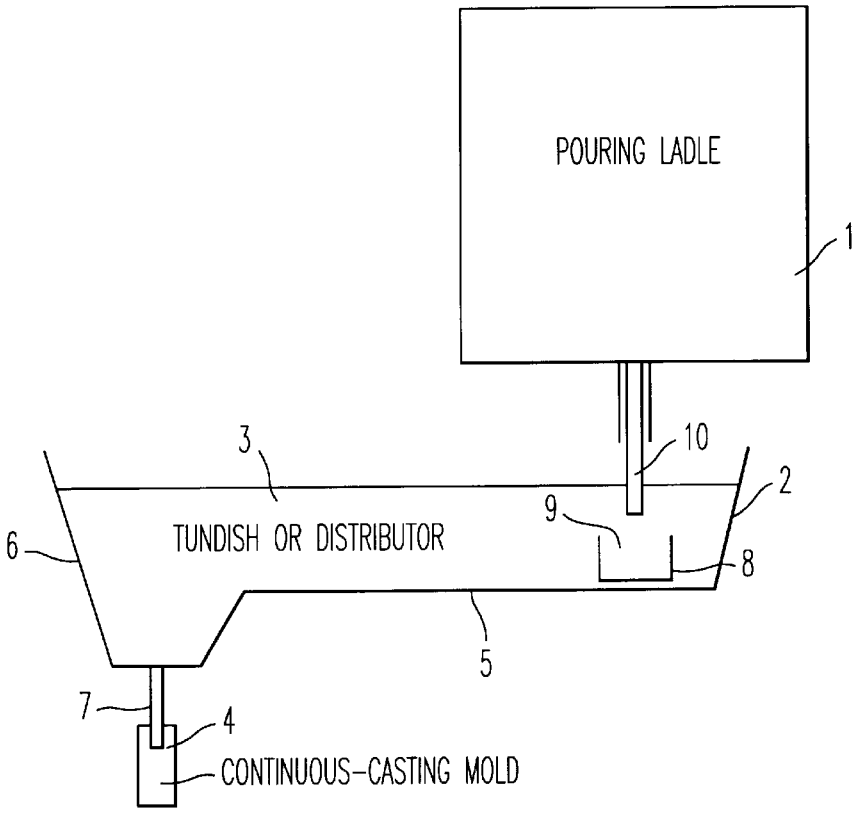
FIG. 1 is a diagram showing a sequence in the downstream production of a steel.

In the downstream production of a metal, in particular steel, as shown in FIG. 1, a pouring ladle 1 feeds a feed reservoir 2, also called a distributor or tundish, the feed reservoir 2 pouring the liquid metal 3 in one or more casting lines into one or more casting molds 4.

The metal-feed reservoir 2 comprises a refractory bottom 5, refractory walls 6 intended for retaining the molten metal in the feed reservoir 2, at least one nozzle 7 placed in the refractory bottom 5, which discharges, as an outflow, the molten metal in the reservoir 2. A refractory buffer 8, defining a cavity 9, is provided on the bottom 5 of the reservoir 2. It is intended for receiving a jet 10 of molten metal coming from the ladle 1 which is moved above the reservoir 2.

Figure 2:
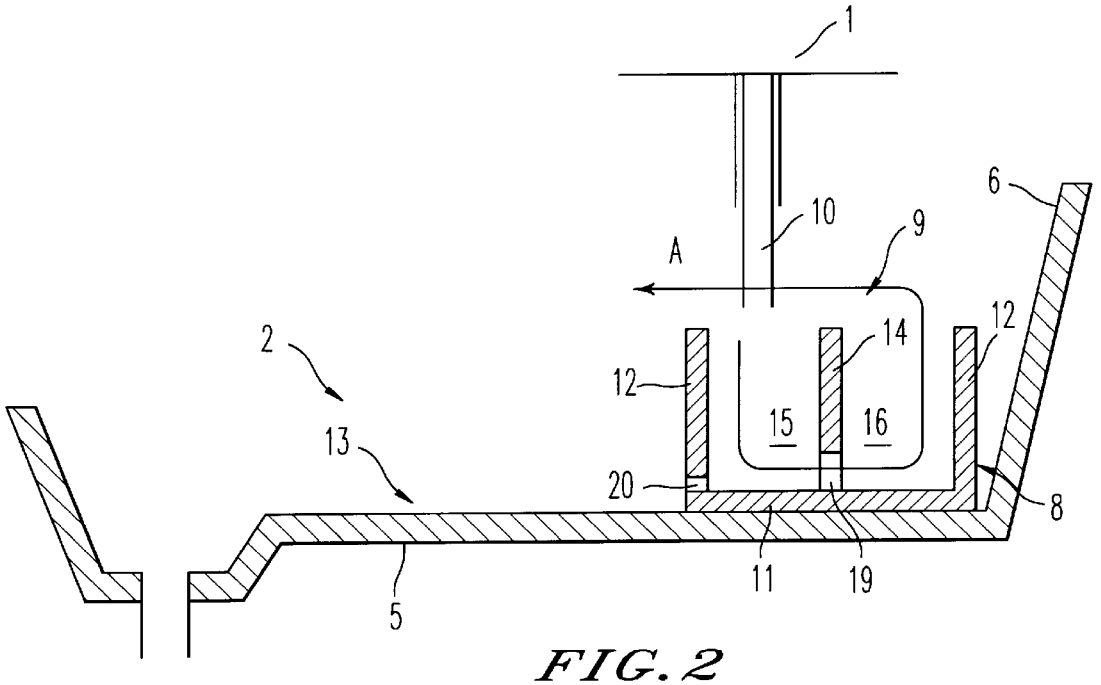
FIG. 2 is a representation, in cross section, of an example of an embodiment of a refractory buffer according to the invention, placed in a feed reservoir.

In a first form of the invention, in the field of steel production, as shown in FIG. 2, the cavity 9 of the buffer 8, shown in section in a plane containing the longitudinal axis of a hole 20, is formed by a buffer bottom 11 and an approximately vertical partition 12. The buffer is provided on the bottom 5 of the reservoir in order, on the one hand, to receive a jet 10 of molten steel coming from the ladle 1 which is moved above said reservoir 2 and, on the other hand, to ensure that said reservoir 2 is separated into two spaces, a first space 13 having at least one nozzle and a second space, the cavity 9 of the buffer bottom 11, confining the molten steel, which steel then flows out into the space 13 by spilling over the top of the partition 12.

The buffer makes it possible, by confining the steel in the cavity 9, the second space, to break the initial energy of the flow of steel entering the reservoir and then to direct the molten steel toward the surface, over the entire width of the reservoir. The buffer consequently limits the turbulence of the incoming jet of steel, by reducing its energy. The buffer 8 is a component made of refractory concrete, possibly made as one piece, provided on the bottom 5 of the reservoir and arranged vertically below the shroud tube for the jet 10 from the pouring ladle 1.

According to one characteristic of the invention, the buffer bottom 11, the partition 12 of which defines the second space, is divided into two zones by a barrier 14, a zone 15 receiving the jet 10 of steel and a zone 16 in which the metal rises, the latter zone being located on the opposite side from the first space 13 with respect to the jet 10.

The barrier 14 ensures that the flow of steel passes from the zone 15 to the zone 16 in which said steel rises, by means of at least one rise hole 19 passing through the barrier 14.

The rise hole 19 in the barrier 14 is located close to the buffer bottom 11.

The buffer orients the flow of the incoming metal in a movement as shown by the arrow A.

The buffer has, piercing the partition 12, at least one drain hole 20 ensuring, on the one hand, that the steel flows out into the bottom 5 of the space 13 of the reservoir, in particular before spillover of the steel filling the buffer 8, and ensuring, on the other hand, that the cavity 9 of the buffer is drained at the end of casting.

Figure 3:
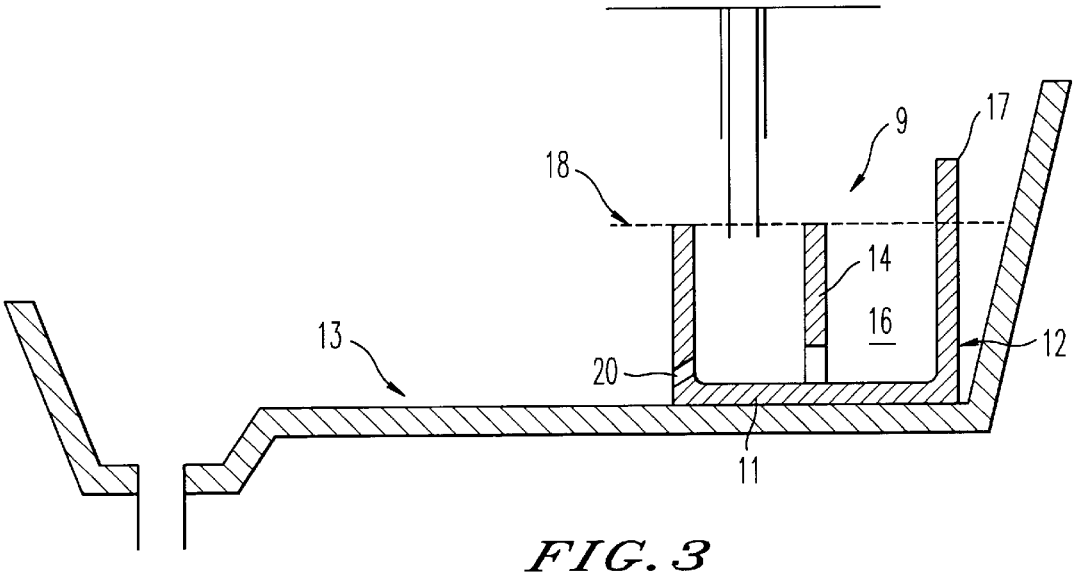
FIGS. 3, 4 and 5 are a representation, in cross section, of other examples of an embodiment of a refractory buffer according to the invention.
Figure 4:
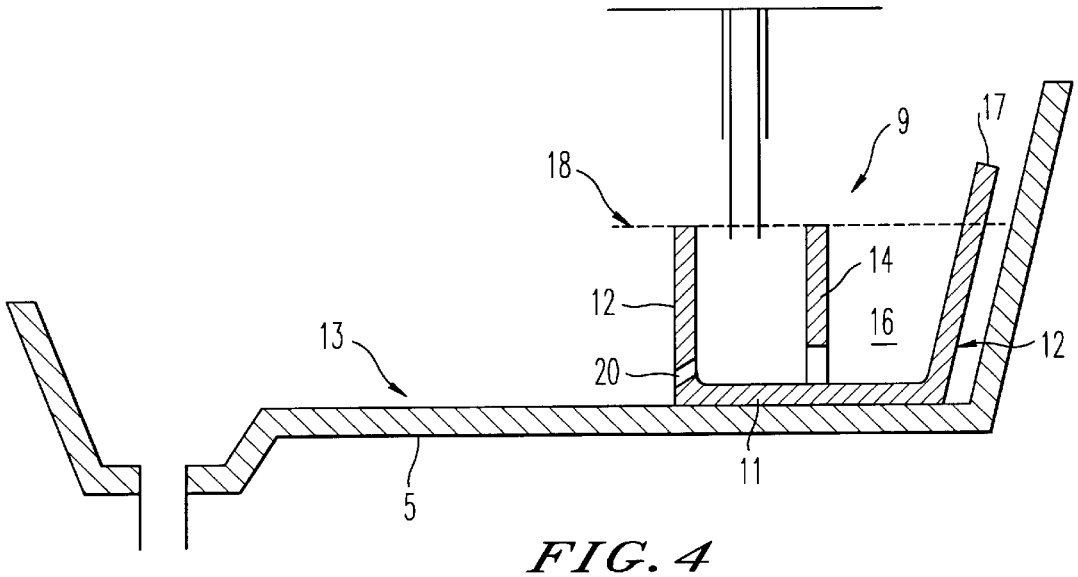

As shown in FIG. 3, the buffer, shown in section in the plane containing the longitudinal axis of the hole 20, includes at least one part 17 of the partition 12 extending above the spillover level 18 of the buffer. The part 17 of the partition 12 of the buffer bottom 11 provided in the zone 16 in which the steel rises, which sends the steel back toward the space 13, may be inclined so as to facilitate the rise of said steel, as shown in FIG. 4.

The buffer may have any geometrical shape, depending on the shape of the reservoir. Preferably, it is parallelepipedal.

The buffer according to the invention described above relates to a monolithic buffer which can be placed in any type of reservoir, without any shape limitation. The steel contained in the spaces, which can exist on the outside between the walls 6 of the reservoir and the partitions 12 of the buffer, can flow around the periphery of said buffer.

Figure 5:
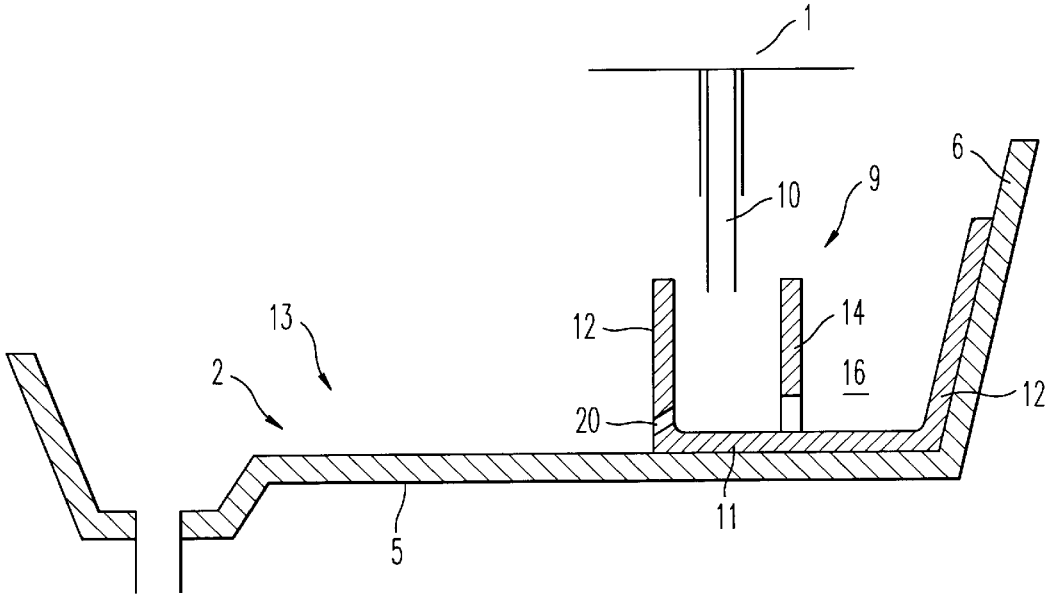

In a preferred form of the invention, as shown in FIG. 5, the buffer bottom 11 partly matches the shape of at least one wall 6 of the reservoir 2 so that the zone 16 in which the steel rises is located on the opposite side from the first space 13 having at least one nozzle, with respect to the jet 10 of steel leaving the ladle 1.

Keeping the same principle, it is possible to combine the partition 12 of the buffer with the walls 6 of the reservoir, the walls 6 of the reservoir partly forming the cavity of the buffer bottom 11, the zone 15 which receives the jet of steel and the zone 16 in which the steel rises.

Figure 6:
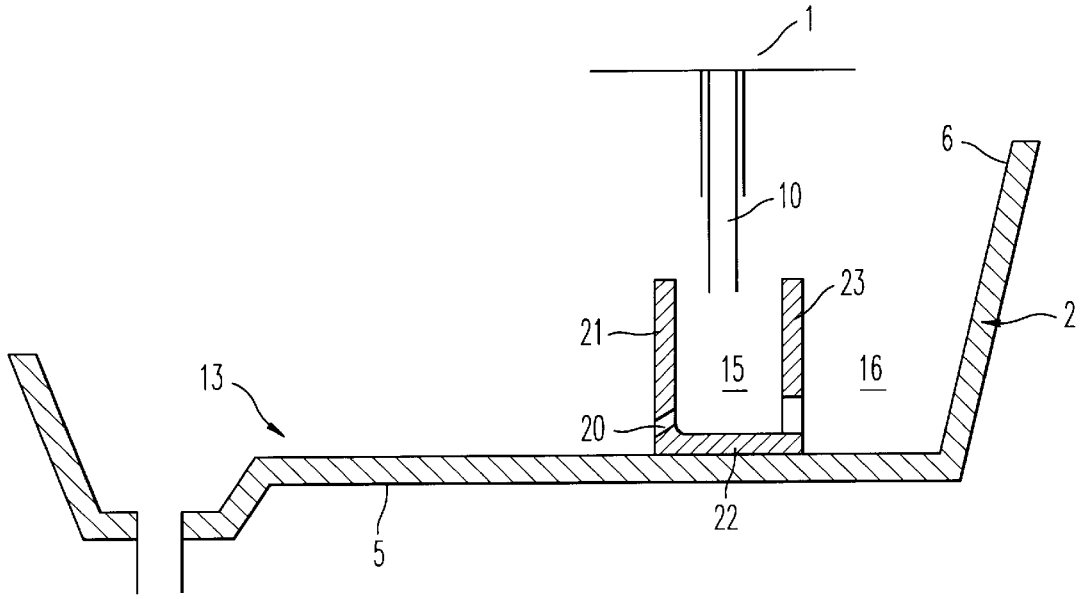
FIG. 6 is a representation, in cross section, of another example of an embodiment of a refractory buffer according to the invention, associated with the walls of the reservoir.
Figure 7:
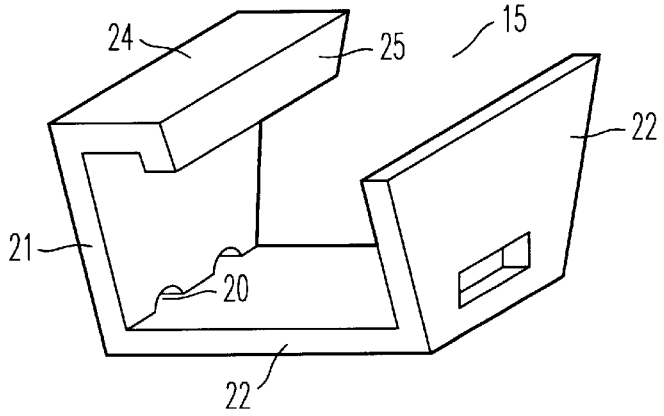
FIG. 7 is a representation, in perspective, of a buffer of the type shown in FIG. 6.

In this form of the invention, the buffer shown in FIG. 6 is composed of a separating partition 21, a bottom 22, and a barrier 23 defining a C-shaped section. The zone 16 is provided between a part of the wall 6 of the reservoir and the barrier 23 of the buffer. The buffer is shown in a general way, in perspective, in FIG. 7. As shown in this figure, the buffer may include, on the partition 21, a rim 24 extending horizontally toward the zone 15.

The rim 24 may terminate in a flanged edge 25, closing up on itself the flow of steel in the space 15.

Figure 8:
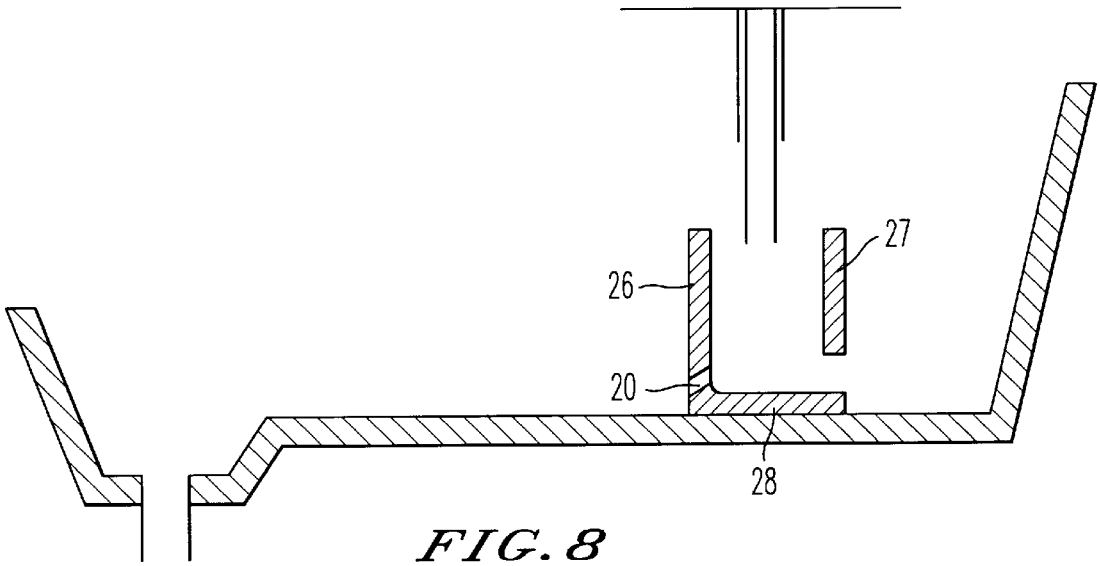
FIG. 8 is a representation, in cross section, of another example of an embodiment of a refractory buffer according to the invention, associated with the walls of the reservoir.
Figure 9:
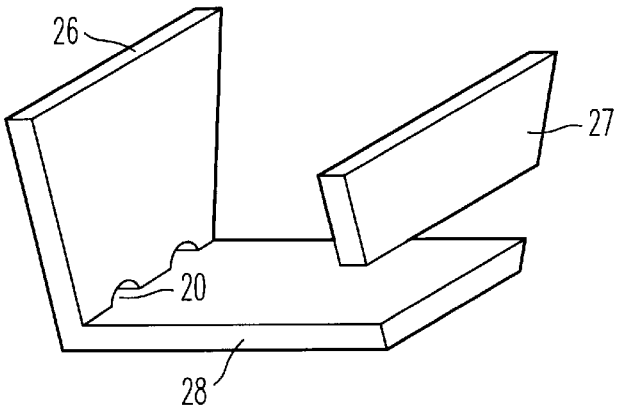
FIG. 9 is a representation, in perspective, of the buffer shown in FIG. 8.

In another form of the invention shown in FIGS. 8 and 9, the buffer is composed of a separating partition 26, a barrier 27 and a bottom 28, in two separate pieces, the separating partition 26 forming an L-shaped section with a buffer bottom 28.

The bottom 22 and/or 28 constitutes a relatively large reserve of refractory, which reserve reduces the wear resulting from the violent impact of the incoming jet of molten steel, in particular when the ladle 1 is opened.

When the bottom 5 of the reservoir can withstand the impact of the jet of steel coming from the ladle, the buffer is essentially composed of a separating partition 26 and a barrier 27, it being possible to dispense with the bottom 22, 28.

Figure 10:
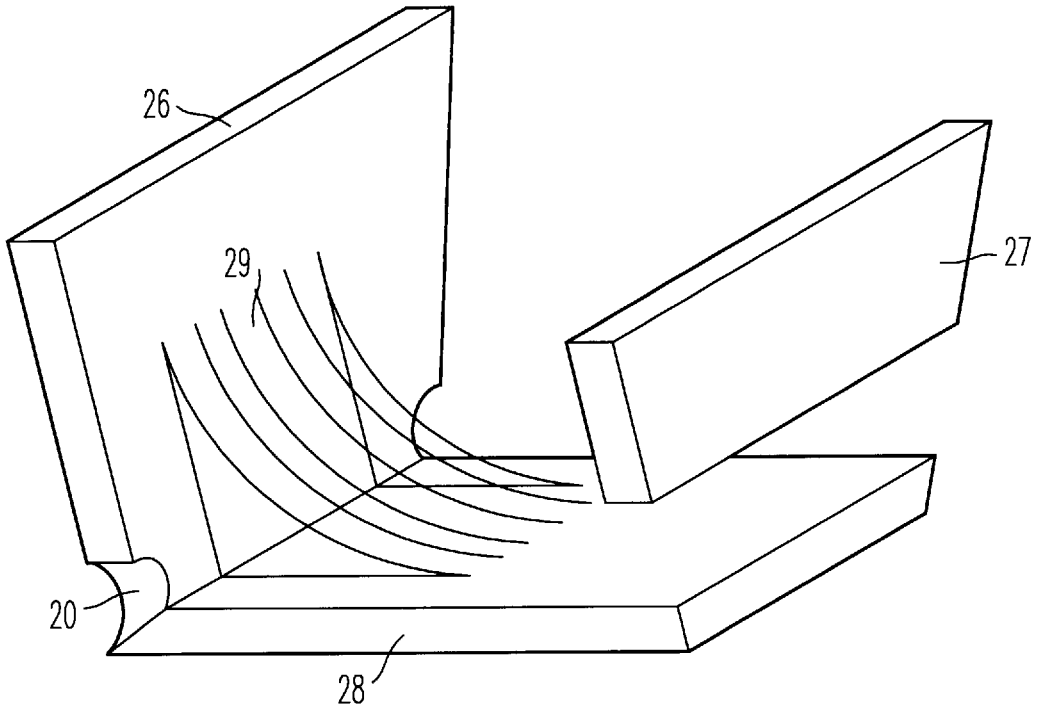
FIG. 10 is another representation, in perspective, of the buffer shown in FIG. 9.

In another manner, as shown in FIG. 10, the bottom 11, 22, 28 includes, in the zone receiving the molten metal, a wearing mass 29 comprising at least one inclined slope. The function of the inclined slope is to direct the jet of metal towards the barrier 14 and the rise hole 19 which passes through the barrier 14. The inclined slope may have a face of a particular shape such as a plane, concave or convex shape.

The proposed reservoir, provided with the buffer according to the invention, optimizes the reduction in the turbulence of the liquid steel in the impact zone of the reservoir by virtue of the creation of zones of great energy reduction. It makes it possible to orient the incoming flow of metal toward the surface and in the direction away from the nozzles for feeding the casting lines. It also optimizes the short-circuit times and the residence times, thereby improving the state of cleanliness of the steel produced.

The buffer may be located in an extreme part of a reservoir, when the reservoir has the general shape of an elongate parallelepiped. When the reservoir has the general shape called a T-shape, the nozzles are aligned in the first space, which is the bar of the T. The buffer is then placed in the part which is perpendicular to the bar of the T, the jet of molten steel coming from the ladle being oriented in the direction away from the first space, and, after its rise being moved so that the wave formed is oriented toward the jet from the ladle or cuts the jet from the ladle transversely toward the first space, according to the process of the invention.

I claim:

1. A feed reservoir for holding a molten metal therein, comprising:

a refractory bottom;

refractory walls formed at respective edges of said refractory bottom so as to form an internal volume that receives said molten metal;

a nozzle formed in said refractory bottom and configured to dispense said molten metal from said internal volume into a mold;

a refractory buffer disposed in said internal volume so as to divide said internal volume into a first space that is outside said refractory buffer and a second space that includes said refractory buffer, said first space containing said nozzle, said refractory buffer having, a buffer bottom and a vertical partition that jointly define a cavity in said second space, and a barrier that divides said cavity into a first zone and a second zone that initially confines the molten metal prior to being dispensed to said mold, wherein said first zone configured to receive a jet of the molten metal from an overhead source, said second zone configured to receive the molten metal from the first zone and have said molten metal rise therein up to a predetermined spillover level, a portion of said molten metal spilling over the vertical partition and into said first space when said molten metal rises past said spillover level, and said second zone being on an opposite side of said first space with respect to said first zone.

2. The feed reservoir of claim 1, wherein:

at least a portion of said vertical partition extends above said predetermined spillover level.

3. The feed reservoir of claim 1, wherein:

the barrier includes a rise hole through which the molten metal passes from the first zone to the second zone.

4. The feed reservoir of claim 3, wherein:

the rise hole is formed in the barrier close to the buffer bottom.

5. The feed reservoir of claim 1, wherein:

the buffer has a drain hole formed therethrough.

6. The feed reservoir of claim 1 wherein:

the refractory buffer being in contact with at least one of the refractory walls such that the first zone is located opposite from the first space with respect to the jet of metal.

7. The feed reservoir of claim 1, wherein:

the barrier defines a C-shaped section.

8. The reservoir of claim 1, wherein:

the partition and barrier are separate pieces, the partition being a separating partition forming an L-shaped section with the buffer bottom.

9. A process for transferring a molten metal from a pouring ladle to a casting line, comprising the steps of:

receiving a jet of the molten metal from the ladle in a first zone of a refractory buffer, said refractory buffer being disposed in an internal volume of a feed reservoir having a refractory bottom, refractory walls and a nozzle, said refractory buffer dividing said internal volume into a first space that is external to said refractory buffer and a second space that includes the refractory buffer, said nozzle being in the refractory bottom in the first space;

passing said molten metal from said first zone into a second zone of said refractory buffer, said first zone being separated from said second zone by a barrier, said second zone having a predetermined capacity for retaining said molten metal that is set by a spillover level at a top of said second zone;

raising an uppermost level of the molten metal in the second zone up to the spillover level;

spilling the molten level from the second zone into the internal volume of the feed reservoir;

moving the jet coming from the ladle in the refractory buffer so as to orient the jet in a direction away from the first space;

directing the jet so that the molten metal rises approximately vertically in the refractory buffer; and moving the molten metal so as to direct a wave generated by a rise in the molten metal to move transversely from the jet toward the direction of the first volume.

* * * * *

UNITED STATES PATENT AND TRADEMARK OFFICE

CERTIFICATE OF CORRECTION

PATENT NO. : 5,868,955

DATED : February 9, 1999

INVENTOR(S): Hervé TAVERNIER, et al.

It is certified that an error appears in the above-identified patent and that said Letters Patent is hereby corrected as shown below:

On the title page, item [75], the second inventor's data is missing. It should be:

--Etienne HAVETTE, Albertville, France--

Signed and Sealed this

Tenth Day of August, 1999

*Attest:*

Q. TODD DICKINSON

*Attesting Officer*

*Acting Commissioner of Patents and Trademarks*